US009694328B2

(12) United States Patent
Smith

(10) Patent No.: US 9,694,328 B2
(45) **Date of Patent: *Jul. 4, 2017**

(54) BEVERAGE AERATION

(71) Applicant: Owens-Brockway Glass Container Inc., Perrysburg, OH (US)

(72) Inventor: Roger P. Smith, Perrysburg, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/046,657

(22) Filed: Feb. 18, 2016

(65) Prior Publication Data

US 2016/0158712 A1 Jun. 9, 2016

Related U.S. Application Data

(62) Division of application No. 13/484,643, filed on May 31, 2012, now Pat. No. 9,283,526.

(51) Int. Cl.
*B01F 3/04* (2006.01)
*B65D 1/02* (2006.01)
(Continued)

(52) U.S. Cl.
CPC ..... *B01F 3/04794* (2013.01); *B01F 3/04737* (2013.01); *B01F 3/04751* (2013.01); *B65D 1/023* (2013.01); *B65D 39/0005* (2013.01); *B65D 85/72* (2013.01); *B01F 2215/0072* (2013.01)

(58) Field of Classification Search
CPC ..... B01F 3/04737; B01F 3/04794; B01F 3/04751; B01F 2215/0072; B65D 85/72; B65D 1/023; B65D 39/0005
See application file for complete search history.

(56) References Cited

U.S. PATENT DOCUMENTS 3,091,373 A 5/1963 Kirschenbaum
4,193,524 A 3/1980 Fleming
(Continued)

FOREIGN PATENT DOCUMENTS

DE 20119154 3/2002
EP 1716917 11/2006

OTHER PUBLICATIONS

PCT Search Report and Written Opinion, Int. Application No. PCT/US2013/032959, Int. Filing Date: Mar. 19, 2013, Applicant: Owens-Brockway Glass Container Inc., Mail Date: Aug. 19, 2013.

*Primary Examiner* — Amber R Orlando
*Assistant Examiner* — Stephen Hobson

(57) ABSTRACT

A beverage package includes a bottle including a base, a sidewall extending from the base, a shoulder extending from the sidewall, and a neck extending from the shoulder and including an interior, an interior surface, and a mouth having an end surface. The beverage package also includes an aerator separate from the bottle, extending across the interior of the bottle neck, and disposed entirely within the interior of the neck and spaced axially from the end surface of the bottle neck, and including an inlet end, an outlet end axially spaced from the inlet end, an outer wall in contact with the interior surface of the bottle neck, and a baffle disposed radially inwardly of the outer wall and axially between the inlet and outlet ends.

24 Claims, 9 Drawing Sheets

(51) Int. Cl.
*B65D 39/00* (2006.01)
*B65D 85/72* (2006.01)

(56) References Cited

U.S. PATENT DOCUMENTS

| | | | | |
|---|---|---|---|---|
| 6,568,660 | B1 | 5/2003 | Flanbaum | |
| D633,745 | S | 3/2011 | Ross | |
| D635,823 | S | 4/2011 | Mauffette | |
| 2009/0324429 | A1 | 12/2009 | Azimov | |
| 2010/0091605 | A1 | 4/2010 | Rasmussen et al. | |
| 2010/0098816 | A1* | 4/2010 | Jain | B65D 81/245 426/124 |
| 2010/0264107 | A1 | 10/2010 | Lonsway et al. | |
| 2011/0024461 | A1 | 2/2011 | Kilduff et al. | |
| 2012/0074092 | A1 | 3/2012 | Devoy et al. | |
| 2012/0100266 | A1* | 4/2012 | Nicholson | B65D 17/165 426/115 |
| 2012/0298532 | A1* | 11/2012 | Woolf | B65D 81/3205 206/0.5 |
| 2015/0096913 | A1* | 4/2015 | Kitcher | B65D 1/023 206/459.5 |
| 2015/0203235 | A1* | 7/2015 | Laib | B65D 1/023 215/40 |
| 2016/0176589 | A1* | 6/2016 | Averill | B01F 5/0619 222/190 |

* cited by examiner

BEVERAGE AERATION

The present disclosure is directed to dispensing devices and, more particularly, to dispensing devices to aerate beverages.

BACKGROUND AND SUMMARY OF THE DISCLOSURE

U.S. Patent Application Publication 2010/0264107 discloses a bottle of one-piece integrally formed construction having a body with a closed base and a shoulder at an end of the body remote from the base, and a neck extending from the shoulder along an axis and terminating in a neck finish for attachment of a closure, wherein the neck includes a plurality of angularly spaced internal spiral ribs for affecting flow of liquid from the body through the neck.

A general object of the present disclosure, in accordance with one aspect of the disclosure, is to provide a bottle including an aerator disposed entirely within and retained by the bottle to aerate a beverage as it flows through the bottle before being dispensed out of the bottle.

The present disclosure embodies a number of aspects that can be implemented separately from or in combination with each other.

A beverage package in accordance with one aspect of the disclosure includes a bottle including a base, a sidewall extending from the base, a shoulder extending from the sidewall, and a neck extending from the shoulder and including an interior, an interior surface, and a mouth having an end surface. The beverage package also includes an aerator separate from the bottle, extending across the interior of the bottle neck, and disposed entirely within the interior of the neck and spaced axially from the end surface of the bottle neck, and including an inlet end, an outlet end axially spaced from the inlet end, an outer wall in contact with the interior surface of the bottle neck, and a baffle disposed radially inwardly of the outer wall and axially between the inlet and outlet ends.

In accordance with another aspect of the disclosure, there is provided a beverage aeration device that includes an annular collar to be press fit into a bottle neck, a wall extending inwardly from said collar and having a plurality of air vent apertures, a tubular passage extending from an inner end of said wall, and an aerating head on an end of said tubular passage remote from said wall. The head is circular and has peripheral apertures for passage of a beverage from said device.

In accordance with a further aspect of the disclosure, there is provided a method of producing a beverage package that includes forming a bottle including a base, a sidewall extending from the base, a shoulder extending from the sidewall, and a neck extending from the shoulder and including an open end having an end surface, an interior, and an interior surface. The method also includes inserting an aerator into the bottle so that the aerator is disposed entirely within the interior of the bottle neck, spaced axially from the end surface of the bottle neck, and extends across the interior of the bottle neck.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
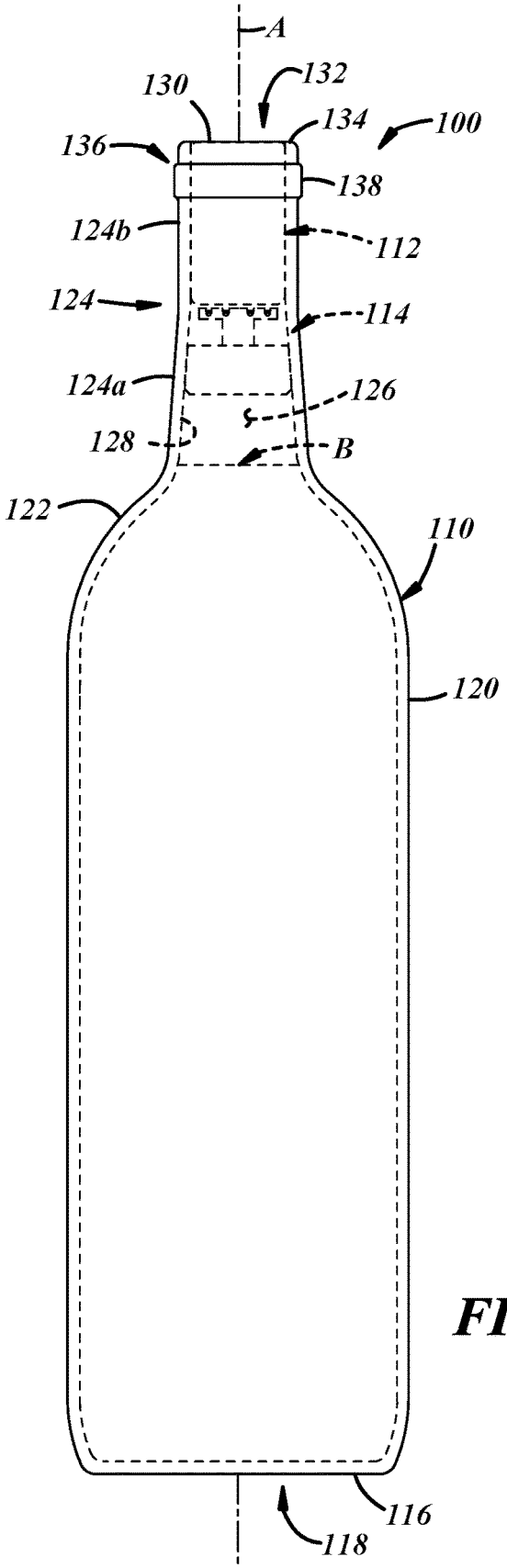
FIG. 1 is an elevational view of a beverage package including a bottle, and a stopper and an aerator disposed in the bottle, in accordance with a first illustrative embodiment of the present disclosure.

FIG. 1 illustrates a package 100 including a bottle 110, and a closure or stopper 112 and an aerator 114 disposed in the bottle 110. The package may be used to contain and dispense wine, liquor, beer, or any other suitable beverage B. As will be discussed below in detail, the package 100 is also configured to aerate the beverage B as it flows by gravity through the bottle B before being dispensed from the bottle 110. Accordingly, no devices, tools, or the like external to the bottle 110 are necessary to aerate the beverage B. The aerator 114 may be used, for example, to agitate the beverage for mixing with air and/or to release gas from the beverage to aerate wine, form a head in beer, or for any other suitable purpose.

The bottle may include a base 116 at a closed end 118, a sidewall 120 extending from the base 116 along a longitudinal axis A of the package 100, a shoulder 122 extending from the sidewall in a direction along the axis A, a neck 124 extending from the shoulder 122 in a direction along the axis A. The neck 124 includes an interior 126, an interior surface 128, and a mouth 130 at an open end 132 and having an end surface 134. The base 116 may be flat, or may include a punt or push-up (not shown), or may be shaped in any other suitable configuration. The sidewall 120 may be cylindrical, flat-sided, or shaped in any other suitable configuration. The shoulder 122 may be excurvate or rounded, angled, or shaped in any other suitable configuration. The neck 124 may include a frusto-conical portion 124*a* and a cylindrical portion 124*b*, as shown, or may be cylindrical, or may be shaped in any other suitable configuration. Also, the neck 124 may include a neck finish 136, which may include a retention feature 138 for cooperation with a cap, cover, or the like (not shown). As shown, the bottle 110 is preferably composed of glass, but may be composed of any other suitable material(s) and according to any suitable construction.

The stopper 112 may include an article disposed within the neck of the bottle, as shown, or may include a cap (not shown) that may be carried by the neck finish 136, for example, by threads, crimp, clasp, or in any suitable retention arrangement. The stopper 112 may include a "cork" that may be composed of cork or any other suitable natural material, or of polymeric material or any other suitable synthetic material. The stopper 112 may be press-fit or interference-fit into the mouth 130 of the bottle neck 124.

Figure 1B:
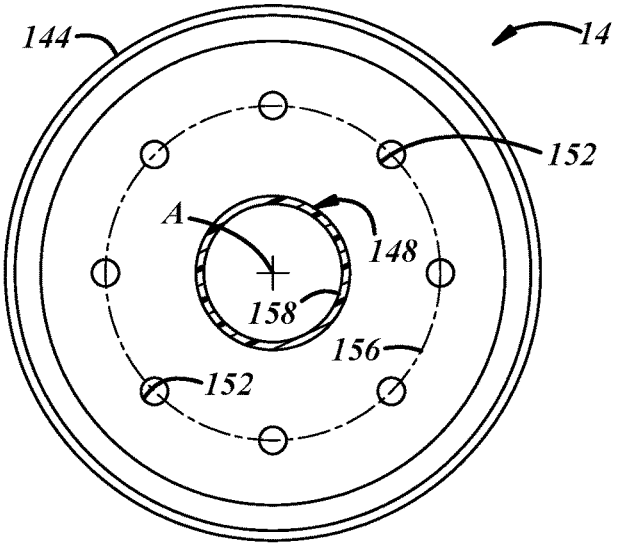
FIG. 1B is an enlarged fragmentary sectional view of the package of FIG. 1, taken substantially along line 1B of FIG. 1A, with the bottle removed for clarity.
Figure 1A:
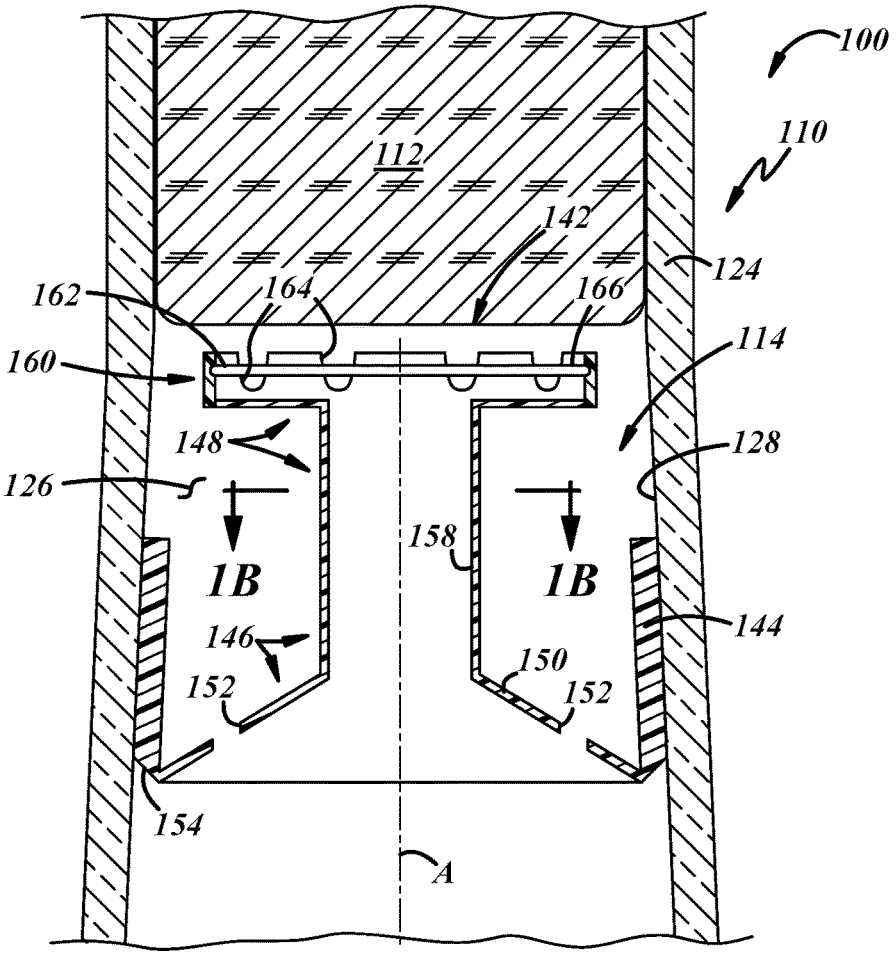
FIG. 1A is an enlarged fragmentary sectional view of the package of FIG. 1, taken substantially along line 1A of FIG. 1.

Referring now to FIG. 1A, the aerator 114 is separate from the bottle 110, extends across the interior 126 of the bottle neck 124. For example, the aerator 114 may extend laterally across the axis A, for instance, from wall-to-wall of the bottle neck 124. Also, the aerator 114 is disposed entirely within the interior 126 of the neck 124 and does not extend out of the bottle neck 124. The aerator 114 includes an inlet end 140, an outlet end 142 axially spaced from the inlet end 140 in an upstream direction, an annular collar or outer wall 144 in contact with the interior surface 128 of the bottle neck 124, a baffle 146 disposed radially inwardly of the outer wall 144 and axially between the inlet and outlet ends 140, 142. The terms "upstream" and "downstream" are used in context with dispensing of beverage out of the bottle, wherein the beverage flows downstream in a direction from the closed end 118 toward the open end 132.

The baffle 146 may restrict, redirect, distribute, agitate, or aerate the beverage B in any other suitable manner so that air is mixed with the beverage B. The baffle 146 may include a conduit 148 that is disposed radially inwardly of the outer wall 144 and that extends in a direction along the axis A, and a wall 150 that extends transversely between the conduit 148 and the outer wall 144 and that includes one or more apertures 152 that may be used for venting air into the bottle 110 when dispensing the beverage B out of the bottle B. The transverse wall 150 may extend from an upstream end of the outer wall 144 in a radially inward and downstream direction. Accordingly, the upstream end of the outer wall 144 may be integral with the transverse wall 150, and a downstream end of the outer wall 144 may be a free end. At the upstream end 140 of the aerator 114, the aerator 114 may include a frusto-conical circumferential surface 154 spaced from the interior surface 128 of the bottle 110. The transverse wall 150 may be frusto-conical and may extend from an upstream end of the outer wall 144 in a radially inward and downstream direction. In turn, the conduit 148 may extend from a downstream end of the transverse wall 150 in a direction along the axis A. The conduit 148 may be cylindrical as shown but may also be funnel-shaped, inverse-funnel-shaped, frusto-conically-shaped, or of any other suitable shape. The conduit 148 may terminate at a downstream end that may be disposed downstream of a downstream end of the outer wall 144. In this embodiment, the transverse wall 150 and/or the conduit 148 may have a wall thickness that is less than the wall thickness of the outer wall 144. As used herein, the term transverse means disposed at some angle with respect to the longitudinal axis A of the package 100 and along any direction intersecting the package 100, and may include but is not limited to a radial direction.

As shown in FIGS. 1A and 1B, the transversely extending wall may include a plurality of the apertures 152 disposed radially outward of the conduit 148 and radially inward of the outer wall 144. The apertures 152 may be arranged in an array 156 of circumferentially spaced apertures 152. As best shown in FIG. 1A, the transverse wall 150 may be a frusto-conical funnel with a larger diameter proximate the upstream end 140 of the aerator 114 and a smaller diameter axially spaced from the upstream end 142 of the aerator 114.

The conduit 148 may include a tubular passage 158 that may extend from a radially inward end or portion of the transverse wall 150. In this embodiment, the inner diameter of the tubular passage 158 may be 30-40% of the inner diameter of the bottle neck 124 where the tubular passage 158 and the neck 124 overlap in an axial direction. The conduit 148 may terminate in an aerating head 160 at the downstream end 142 of the aerator 114 that may be larger than the tubular passage 158 of the conduit 148. The aerating head 160 may function like a shower head to distribute the beverage B. The baffle 146 also may include a plate or disc 162 separate from the conduit 148 and that may be coupled to the aerator conduit 148 at the downstream end of the aerator conduit 148, for example, at the aerating head 160. The downstream end of the aerator conduit 148 may include apertures 164 extending radially therethrough and the disc 162 may extend transversely across the aerator conduit 148 and bisect or intersect the aerator conduit apertures 164. For example, the aerating head 160 may establish a circular base wherein the openings 164 have slots in an axial end thereof with the disc 162 snap fit into an annular groove 166 in the aerating head 160. Although shown as a two-piece assembly, it is also contemplated that the aerator 114 could be molded from a single component with the apertures 164 produced in any suitable manner after molding.

In this embodiment, the aerator 114 is retained within the bottle neck 124 by frictional fit between the aerator outer wall 144 and the bottle neck interior surface 128. For example, the aerator outer wall 144 may be composed of a material with a coefficient of friction suitable to resist slippage between the aerator 114 and the bottle neck interior surface 128. In another example, the aerator outer wall 144 may be constructed with point-contact projections, or any other suitable features to resist slippage between the aerator 114 and the bottle neck interior surface 128. In a further example, the aerator outer wall 144 may be sized with respect to the bottle neck interior surface 128 in such a manner resist slippage between the aerator 114 and the bottle neck 124.

In production of the package 100, the beverage B may be introduced into the bottle 110, and then the aerator 114 may be inserted through the open end 132 into the bottle neck 124 to a predetermined depth into the bottle neck 124 and held by friction to the bottle 110. Thereafter, the stopper 112 may be inserted through the open end 132 into the bottle neck 124 to any suitable depth therein.

In use, the stopper 112 may be removed in any suitable manner, and the bottle 110 may be tipped to a suitable angle at which the beverage B not only flows in a downstream direction but also becomes aerated as it flows through the aerator 114 on its way to and out of the bottle open end 132. In particular, the beverage B may flow from the bottle neck 124 and change direction to travel along the transverse wall 150, change direction again and flow through the conduit 148, impact the disc 162 and change direction again, and flow out of the apertures 164 and change direction again to flow toward and along the interior surface of the bottle neck 124, and eventually be dispensed out of the open end 132. Accordingly, the flow of the beverage B changes direction, impacts various aerator surfaces, and impacts the bottle neck interior surface 128, all of which contributes to aeration of the beverage. While the beverage is being aerated and dispensed, air from outside of the bottle 110 may flow into the bottle neck 124 and through one or more of the vent apertures 152 in the transverse wall 150 of the aerator 114. Therefore, the beverage may flow in a direction away from the closed end 118 from a location upstream of the aerator 114, along the interior surface 128 of the bottle 110, and may be directed or constricted by the aerator 114 to flow radially inwardly away from the bottle interior surface 128 and through the aerator 114 in a direction toward the bottle open end 132, and may be expanded away from the aerator 114 to flow back toward the interior surface 128 of the bottle neck 124. Accordingly, the beverage B may be aerated not only specifically by the aerator head 160, but also may be aerated by the constriction and expansion of the rest of the geometry of the aerator 114, as well as by flow along the interior surfaces of the bottle neck 124, and/or the like.

FIGS. 2A through 8B illustrate many other illustrative embodiments of aerators. These embodiments are similar in many respects to the embodiment of FIGS. 1-1B and like numerals between the embodiments generally designate like or corresponding elements throughout the several views of the drawing figures. Accordingly, the descriptions of the embodiments are incorporated into one another. Additionally, the description of the common subject matter generally may not be repeated.

Figure 2A:
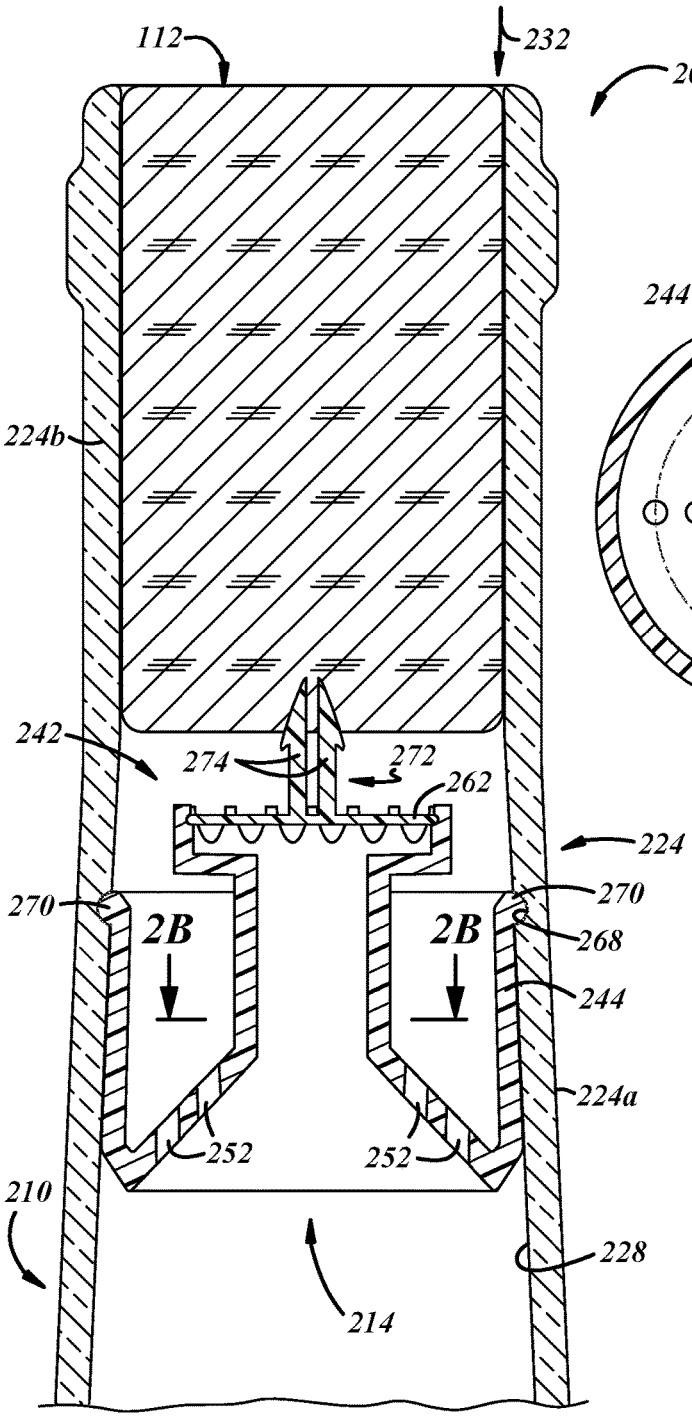
FIG. 2A is a fragmentary sectional view of a package including a bottle, and a stopper and an aerator disposed in the bottle, in accordance with a second illustrative embodiment of the present disclosure.

FIG. 2A illustrates a package 200 that is substantially similar to that shown in FIG. 1A, with some exceptions. The package 200 includes a bottle 210 that may include a neck 224 that may include a frusto-conical portion 224*a* that may at least partially carry an aerator 214 and a cylindrical portion 224*b* carrying the stopper 112. Also, the bottle 210 may include an aerator retention feature 268 integral with an interior surface 228 of the bottle neck 224. In this embodiment, the aerator retention feature 268 includes an annular depression in the interior surface 228 of the bottle neck 224, and the aerator 214 includes a bottle engagement feature 270 that may include an annular projection extending radially outwardly from an outer wall 244 of the aerator 214 for cooperation with the retention feature 268 of the bottle 210 to retain the aerator 214 within the bottle neck 224.

Figure 2B:
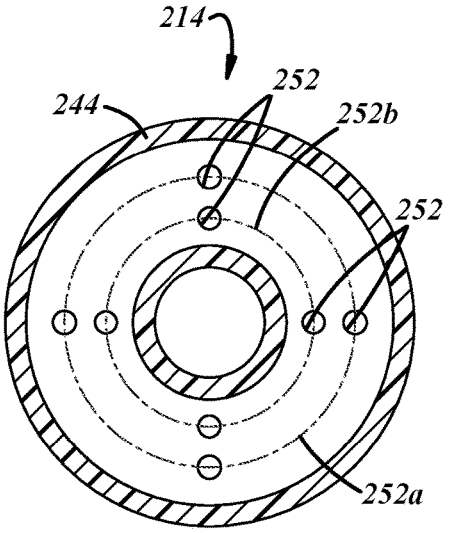
FIG. 2B is fragmentary sectional view of the package of FIG. 2A, taken substantially along line 2B of FIG. 2A, with the bottle removed for clarity.

As also shown in FIG. 2B, the aerator 214 includes a plurality of vent apertures 252. More specifically, the aerator 214 may include one or more radially outer vent apertures 252*a*, and one or more radially inner vent apertures 252*b* disposed radially inwardly of the outer vent apertures. For example, the apertures 252 may include a radially outer array of apertures, and a radially inner array of apertures. The apertures 252 of each array may be circumferentially spaced, and may be spaced in such a manner so as to be radially aligned. As used herein, the term "annular" may include circumferentially extending, and may include circumferentially continuous or circumferentially interrupted structure.

Referring to FIG. 2A, the aerator also may include a stopper coupling feature 272 that may facilitate insertion of both the stopper 112 and the aerator 214 in one manufacturing operation. For example, in this embodiment, the stopper coupling feature 272 may project from an aeration disc 262 in an axial direction downstream of the downstream end 242 of the aerator 214. The stopper coupling feature 272 may include one or more bayonets 274 as shown.

In production of the package 200, the beverage B may be introduced into the bottle 210, and then the aerator 214 may be inserted through the open end 232 into the bottle neck 224 until the retention and engagement features 268, 270 engage. Such engagement may be evidenced by tactile and/or audible feedback by the aerator 214 snapping against the bottle 210.

Figure 3A:
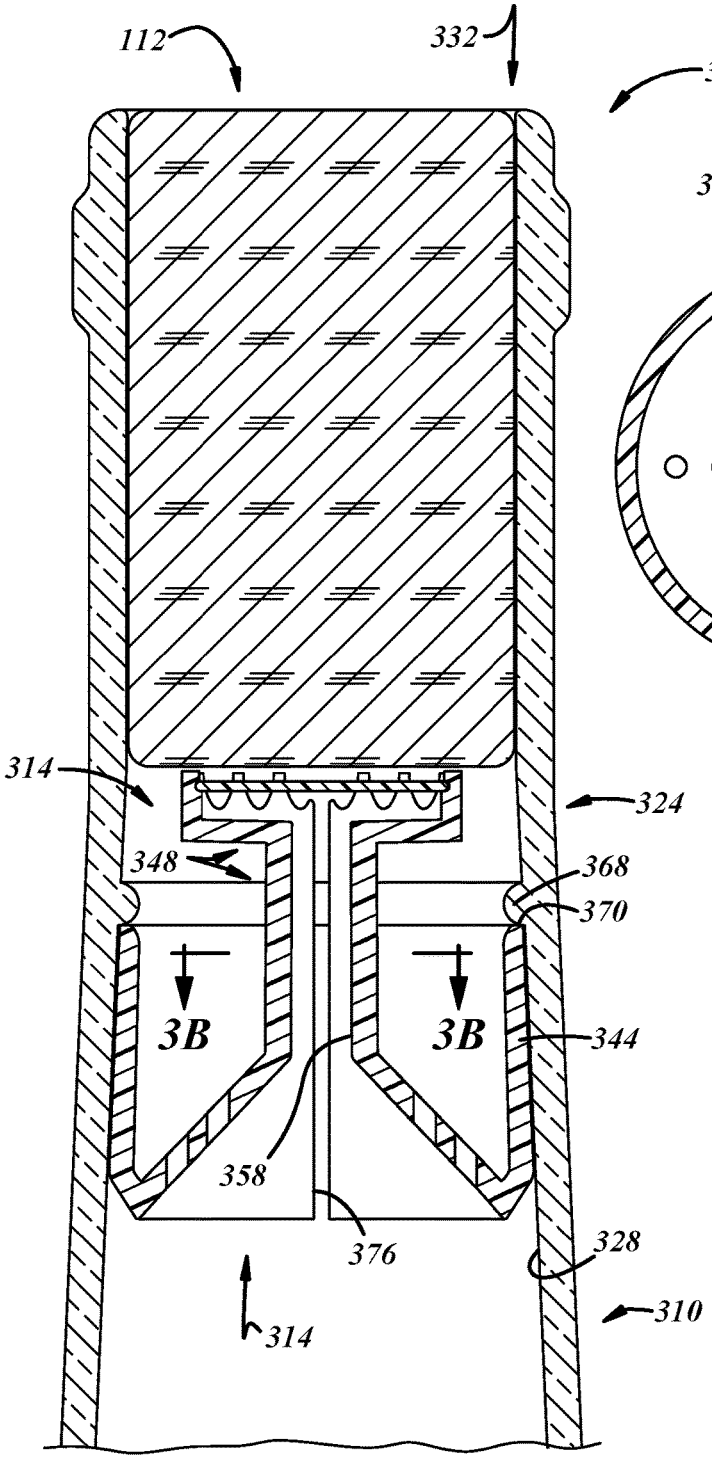
FIG. 3A is a fragmentary sectional view of a package including a bottle, and a stopper and an aerator disposed in the bottle, in accordance with a third illustrative embodiment of the present disclosure.
Figure 3B:
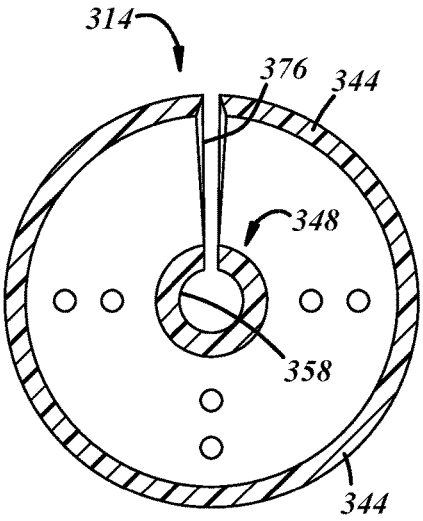
FIG. 3B is fragmentary sectional view of the package of FIG. 3A, taken substantially along line 3B of FIG. 3A, with the bottle removed for clarity.

FIG. 3A illustrates a package 300 that is substantially similar to that shown in FIG. 2A, with some exceptions. In this embodiment, a bottle 310 includes aerator retention feature 368 that may include an annular projection extending radially inwardly from a bottle neck interior surface 328, and the aerator 314 includes a bottle engagement feature 370 that may include an annular shoulder at a downstream end of an outer wall 344 for cooperation with the retention feature 368 of the bottle 310 to retain the aerator 314 within the bottle neck 324. Also, the aerator 314 may include a longitudinally extending opening 376 through the outer wall 344 and/or a conduit 348 to circumferentially interrupt the outer wall 344 and/or the conduit 348. Such an interruption may provide additionally resiliency of the aerator 314 to facilitate insertion and retention thereof in the bottle 310. Additionally, in this embodiment, the inner diameter of a tubular passage 358 may be less than 30% of the inner diameter of the bottle neck 324 where the tubular passage 358 and the neck 324 axially overlap.

In production of the package 300, the beverage B may be introduced into the bottle 310, and then the aerator 314 may be inserted through an open end 332 into the bottle neck 324. The longitudinal opening 376 facilitates radial and/or circumferential compression of the aerator 314, wherein the opening 376 at least partially closes when the aerator 314 is pressed into the bottle neck 324. When the aerator shoulder 370 travels just beyond the retention feature 368, where after the aerator 314 can expand into engagement with the interior surface 328 of the bottle neck 324 as a function of the resiliency of the outer wall 344 and the opening 376. Such engagement may be evidenced by tactile and/or audible feedback by the aerator outer wall 344 snapping against the bottle 310.

Figure 4A:
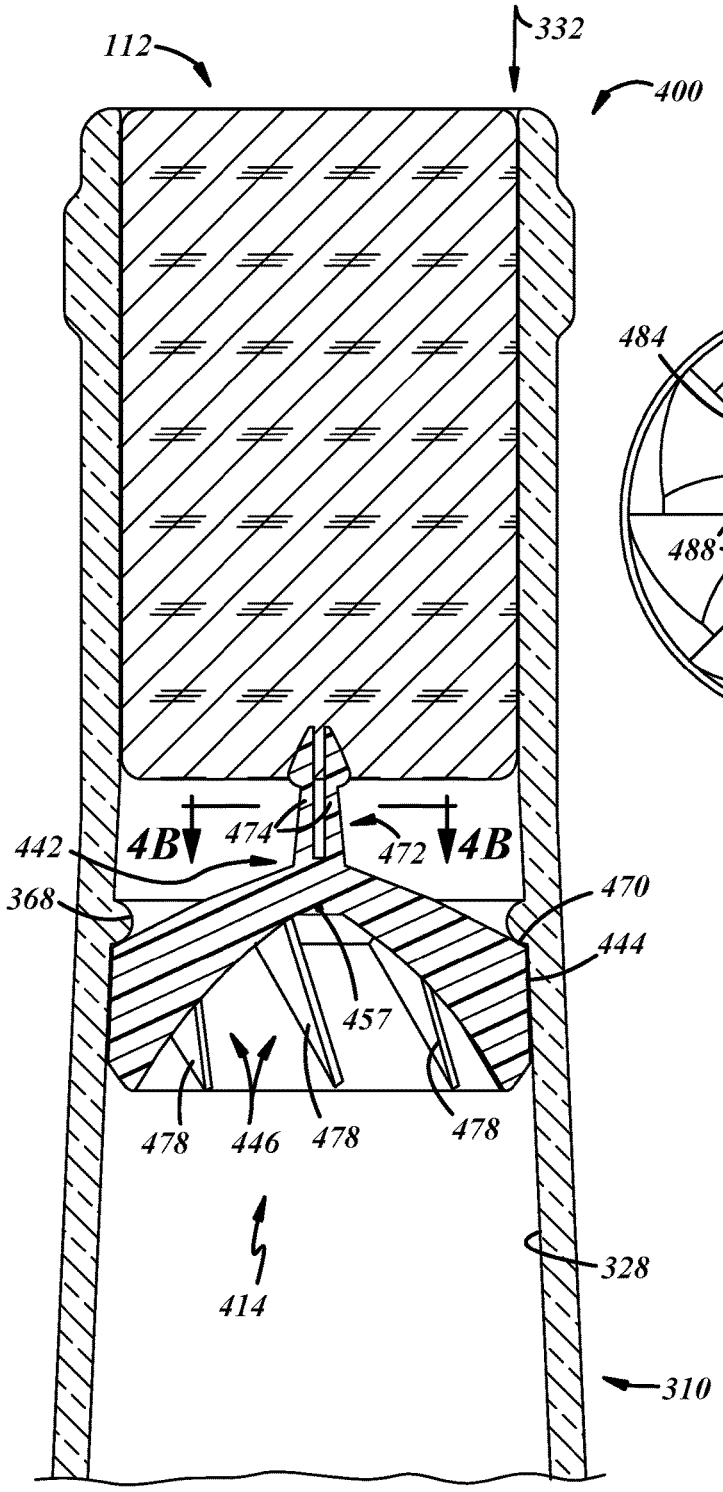
FIG. 4A is a fragmentary sectional view of a package including a bottle, and a stopper and an aerator disposed in the bottle, in accordance with a fourth illustrative embodiment of the present disclosure.
Figure 4B:
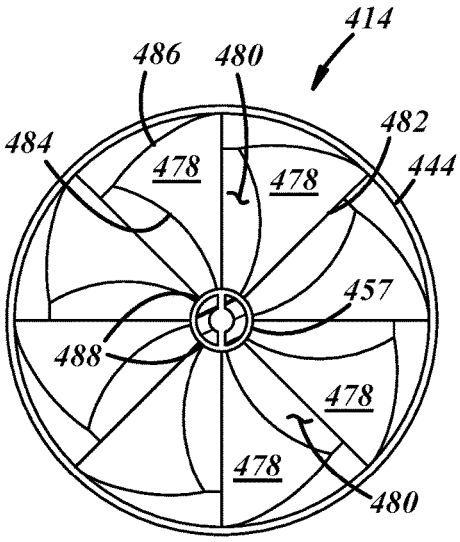
FIG. 4B is fragmentary sectional view of the package of FIG. 4A, taken substantially along line 4B of FIG. 4A, with the bottle removed for clarity.

Referring now to FIG. 4A, a package 400 may include the bottle 310 from FIG. 3A, and the stopper 112 and an aerator 414 disposed in the bottle 310. In this embodiment, the aerator 414 may be a unitary component that does not require assembly of multiple parts and that may be formed, machined, or otherwise produced as a single product. The aerator 414 includes a hub 457 that is connected to an outer wall 444 by a baffle 446 including a plurality of vanes 478 that may be circumferentially spaced, for example, equidistantly from one another. The circumferential spacing of the vanes 478 may be such that circumferential spaces 480 are established between the vanes 478 with no circumferential overlap of the vanes 478. The vanes 478 may form a turbine shape to force beverage flow to change direction and, more specifically, one or more of the vanes 478 may be sail-shaped, for example, having radially extending sides 482 and incurvate-shaped or incurvately extending sides 484. The outer wall 444 may include an annular shoulder 470 for engaging the annular retention feature 368 of the bottle 310, and the vanes 478 may include radially outer portions 486 at the outer wall 444, and the vanes 478 may extend in a direction axially downstream of the shoulder 470 and radially inward and may terminate at the hub 457 for example at radially inner portions 488 of the vanes 478. A stopper coupling feature 472 may project from the hub 457 in an axial direction downstream of a downstream end 442 of the aerator 414. The stopper coupling feature 472 may include one or more bayonets 474 as shown.

In use, a portion of the beverage may flow along a radially inward surface of the outer wall 444 and a larger portion of the beverage may flow along faces of the vanes 478 in an axial and radially inward direction, and through the spaces 480 between the vanes 478. Thereafter, the beverage may exit the aerator 414 at the downstream end 442 thereof and flow radially outwardly toward and along the interior surface 328 of the bottle neck 324, before being dispensed out of the open end 332. Therefore, the beverage may flow in a direction away from the closed end of the bottle 310 from a location upstream of the aerator 314 along the interior surface 328 of the bottle 310, may be directed or constricted by the aerator 314 to flow radially inwardly away from the bottle interior surface 328 and along the aerator 314 in a direction toward the open end 332, and may expand away from the aerator 314 to flow toward the interior surface 328 of the bottle neck 324.

Figure 5A:
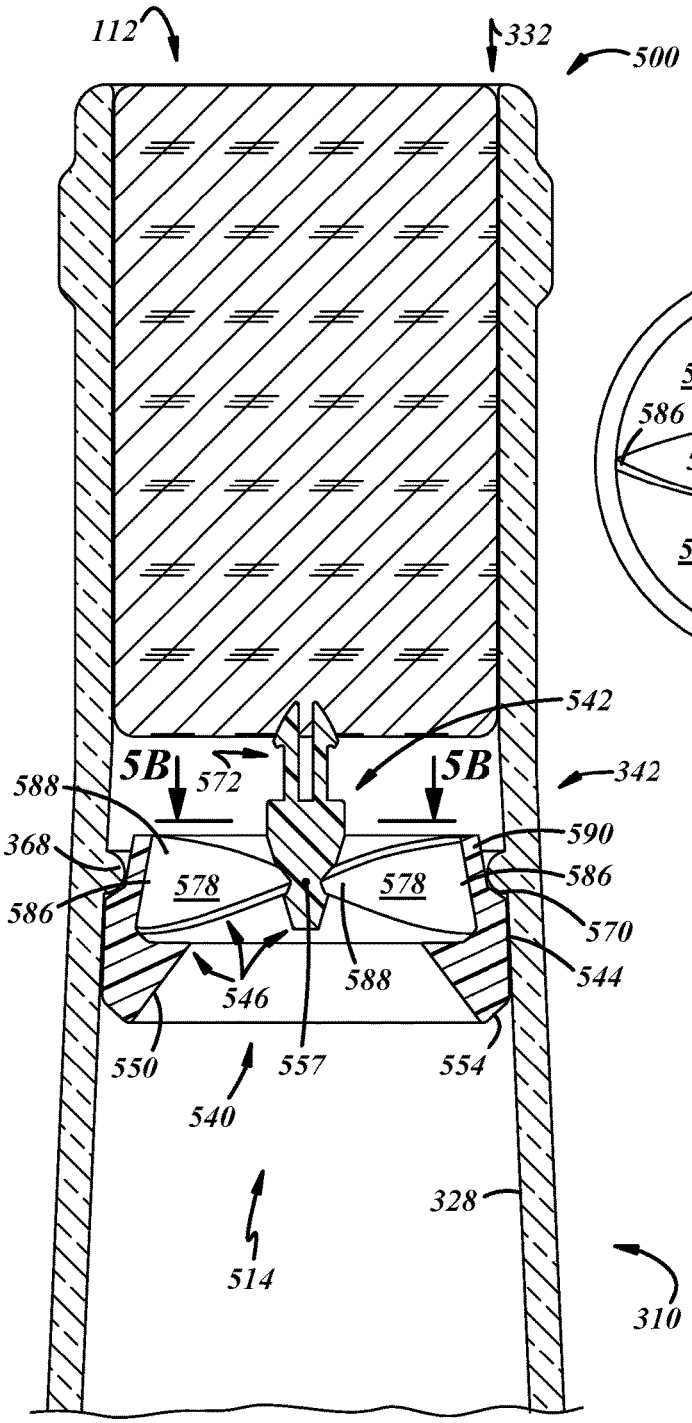
FIG. 5A is a fragmentary sectional view of a package including a bottle, and a stopper and an aerator disposed in the bottle, in accordance with a fifth illustrative embodiment of the present disclosure.
Figure 5B:
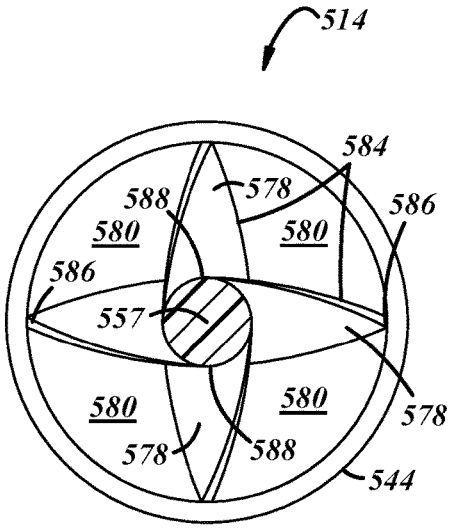
FIG. 5B is fragmentary sectional view of the package of FIG. 5A, taken substantially along line 5B of FIG. 5A, with the bottle removed for clarity.

With reference to FIG. 5A, a package 500 may include the bottle 310, and the stopper 112 and an aerator 514 disposed in the bottle 310. The aerator 514 may include an outer wall 544, and a radially outwardly facing frusto-conical circumferential surface 554 spaced from the interior surface 328 of the bottle 310 at an upstream end 540 of the aerator 514, for the purpose of leading the insertion of the aerator 514 into the bottle 310. The outer wall 544 may include an annular shoulder 570 for engaging the annular retention feature 368 of the bottle 310, and a circumferential extension 590 extending axially and radially inwardly from the outer wall 544 at the shoulder 570.

The aerator 514 includes a baffle 546 that extends across the outer wall 544. The baffle 546 may include a funnel or radially inwardly facing frusto-conical circumferential surface 550 extending from the upstream end 540 toward a downstream end 542 of the aerator 514. The baffle 546 also includes a plurality of vanes 578 that extend, for example radially, between the wall 544 and a hub 557. The vanes 578 may include radially outer portions 586 at the outer wall 544 and the extension 590, and radially inner portions 588 at the hub 557. The vanes 578 may be circumferentially spaced, for example, equidistantly from one another. The circumferential spacing of the vanes 578 may be such that circumferential spaces 580 are established between the vanes 578 with no circumferential overlap of the vanes 578. One or more of the vanes 578 may be helically shaped, for example, like a propeller. The vanes 578 may have excurvate-shaped or excurvately extending sides 584. The hub 557 may be conically or frusto-conically shaped with a smaller circumference at an upstream end and a larger circumference at a downstream end thereof. A stopper coupling feature 572 may project from the hub 557 in an axial direction downstream of the downstream end of the aerator 514.

In use, a portion of the beverage may flow along a radially inward surface of the outer wall 544 and a smaller portion of the beverage may flow along faces of the vanes 578 in an axial and radially inward direction and along the hub 557, which may redirect flow of the beverage in a radially outward direction. Thereafter, the beverage may exit the aerator 514 at the downstream end 542 thereof and flow radially outwardly toward and along the interior surface 328 of the bottle neck 324, before being dispensed out of the open end 332. Therefore, the beverage may flow in a direction away from the closed end of the bottle 310 from a location upstream of the aerator 514 along the interior surface 328 of the bottle 310, may be directed or constricted by the aerator 514 to flow radially inwardly away from the bottle interior surface 328 and through the aerator 514 in a direction toward the open end 332, and may expand away from the aerator 514 to flow toward the interior surface 328 of the bottle neck 324.

Figure 6A:
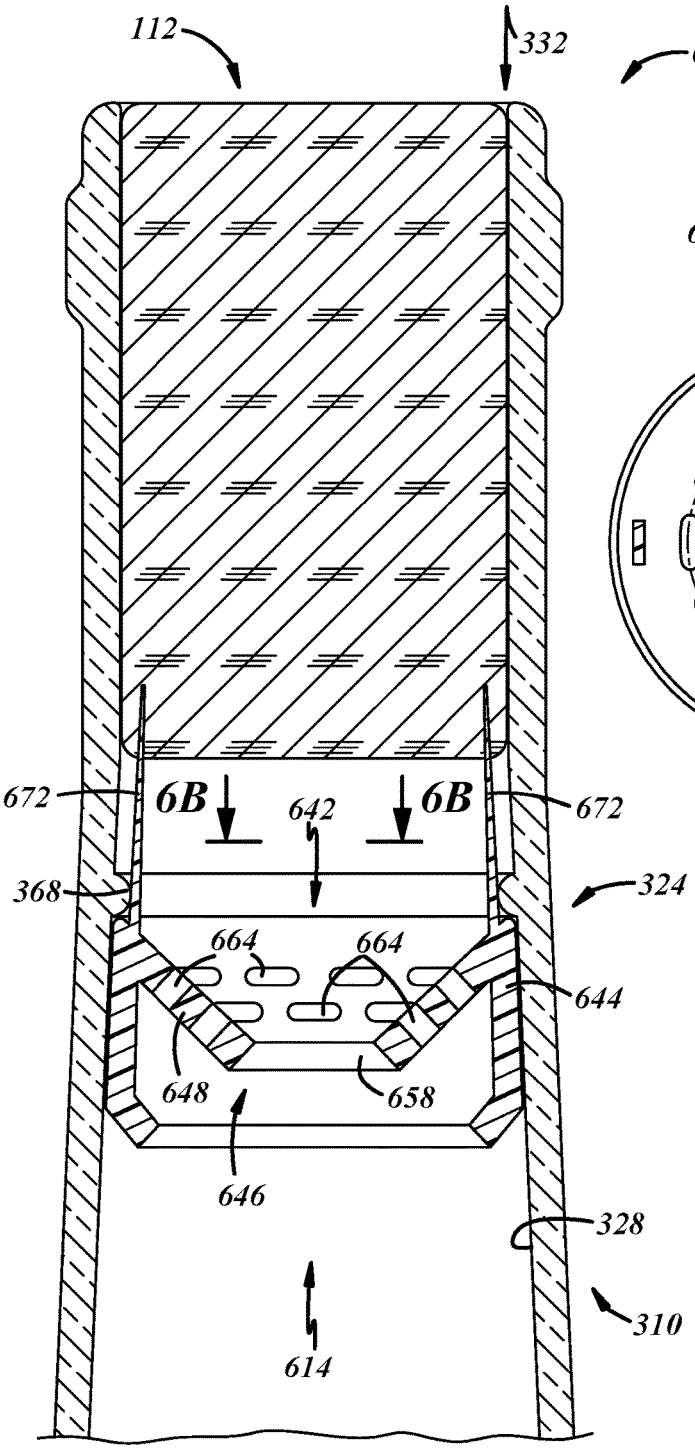
FIG. 6A is a fragmentary sectional view of a package including a bottle, and a stopper and an aerator disposed in the bottle, in accordance with a sixth illustrative embodiment of the present disclosure.
Figure 6B:
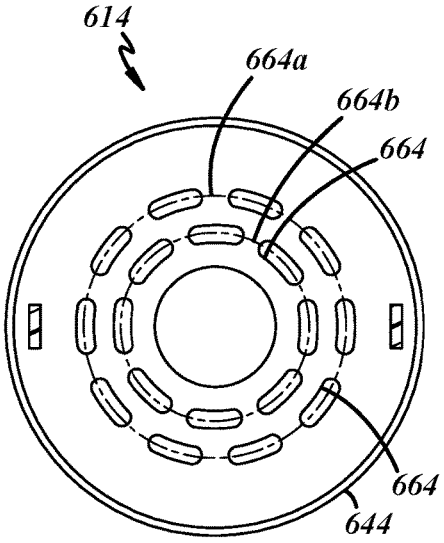
FIG. 6B is fragmentary sectional view of the package of FIG. 6A, taken substantially along line 6B of FIG. 6A, with the bottle removed for clarity.

Referring to FIG. 6A, a package 600 may include the bottle 310, and the stopper 112 and an aerator 614 carried in the bottle 310. The aerator 614 includes an outer wall 644 having an upstream end and a downstream end, and a baffle 646 that may include a frusto-conical wall 648 extending in a radially inward and axially upstream direction from the outer wall 644 and including a central aperture 658 and a plurality of other apertures 664 disposed radially outwardly of the central aperture 658. The other apertures 664 may be arranged in one or more arrays 664*a*, 664*b* of circumferentially spaced apertures 664, for example, a radially inner array 664*b* and a radially outer array 664*a*. The aerator 614 also may include one or more stopper coupling features 672, for example, spikes that may extend from the downstream end of the outer wall in a downstream direction.

In use, a portion of the beverage flows along a radially inward surface of the outer wall 344 and may flow through the baffle apertures 664 which direct flow in a radially inward direction, and another portion may flow through the central aperture 658. Thereafter, the beverage may exit the aerator 614 at a downstream end 642 thereof and flow radially outwardly toward and along the interior surface 328 of the bottle neck 324, before being dispensed out of the open end 332. Therefore, the beverage may flow in a direction away from the closed end of the bottle 310 from a location upstream of the aerator 614 along the interior surface 328 of the bottle 310, may be directed or constricted by the aerator 614 to flow radially inwardly away from the bottle interior surface 328 and through the aerator 614 in a direction toward the open end 332, and may expand away from the aerator 614 to flow toward the interior surface 328 of the bottle neck 324.

Figure 7A:
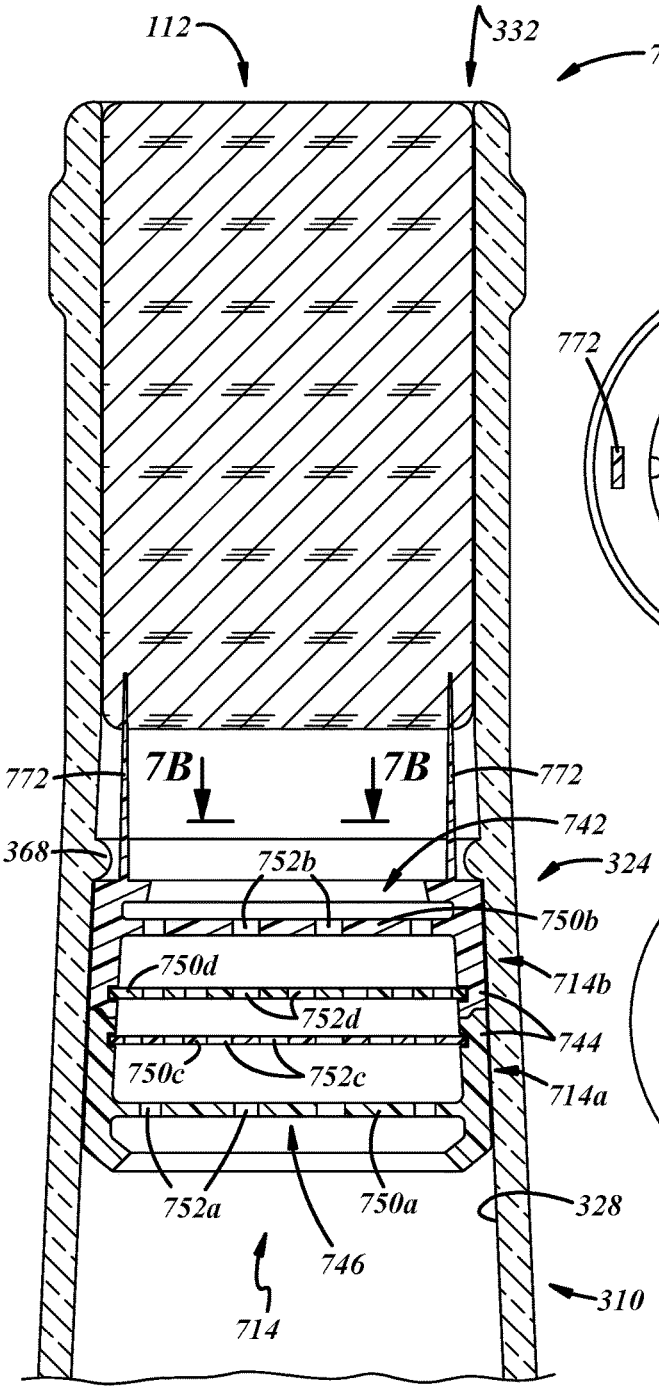
FIG. 7A is a fragmentary sectional view of a package including a bottle, and a stopper and an aerator disposed in the bottle, in accordance with a seventh illustrative embodiment of the present disclosure.
Figure 7B:
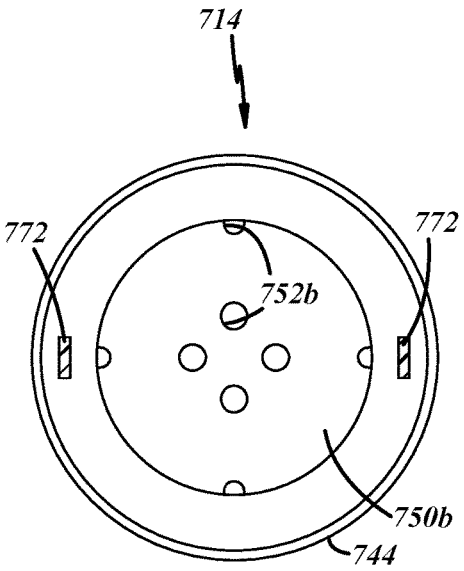
FIG. 7B is fragmentary sectional view of the package of FIG. 7A, taken substantially along line 7B of FIG. 7A, with the bottle removed for clarity.
Figure 7C:
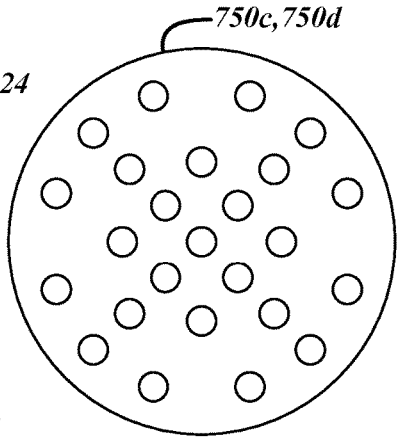
FIG. 7C is a top or plan view of an intermediate wall of the aerator of FIG. 7A.

Referring to FIG. 7A, a package 700 may include the bottle 310, and the stopper 112 and an aerator 714 carried in the bottle 310. The aerator 714 may be of multiple-piece construction. For example, the aerator 714 may include an upstream portion 714*a* and a downstream portion 714*b* coupled to the upstream portion 714*a*. The portions 714*a*, 714*b* may be coupled at corresponding axial end portions of an outer wall 744 thereof by integral fastening, melting or welding, or in any other suitable manner. The aerator 714 includes a baffle 746, which includes a plurality of transverse walls 750*a*, 750*b*, 750*c*, 750*d* extending radially inwardly from an outer wall 744 across the interior of the bottle neck 324. The transverse walls 750*a*, 750*b*, 750*c*, 750*d* may include an upstream wall 750*a* that may be integral with the upstream portion 714*a*, a downstream wall 750*b* that may be integral with the downstream portion 714*b*, an intermediate upstream wall 750*c* that may be separately coupled to the upstream portion 714*a* in a location downstream of the upstream wall 750*a*, and an intermediate downstream wall 750*d* that may be separately coupled to the downstream portion 714*b* in a location downstream of the intermediate upstream wall 750*c* and upstream of the downstream wall 750*b*. The separate walls 750*c*, 750*d* may be snap-fit into corresponding annular reliefs of the respective portions 714*a*, 714*b*. The walls 750*a*, 750*b*, 750*c*, 750*d* may include pluralities of apertures 752*a*, 752*b*, 752*c*, 752*d*. At least one of the walls 750*a*, 750*b*, 750*c*, 750*d* includes a plurality of apertures that are transversely misaligned with respect to another plurality of apertures of at least one other of the walls 750*a*, 750*b*, 750*c*, 750*d*. For example, apertures 752*c* of the intermediate upstream wall 750*c* may be misaligned with one or both of the apertures 752*a*, 752*d* of the upstream and intermediate downstream walls 750*a*, 750*d*. Likewise, the apertures 752*d* of the intermediate downstream wall 750*d* may be misaligned with the apertures 752*b* of the downstream wall 750*b*. Also, the walls 750*a*, 750*b*, 750*c*, 750*d* need not include the same quantities and sizes of apertures. The apertures in the intermediate walls may be smaller and more numerous than the apertures in the upstream and downstream walls, to facilitate flow of the beverage in conjunction with an opposite flow of air into the container, thereby facilitating aeration of the beverage. The aerator 714 also may include a circumferential ledge 790 extending radially inwardly from the outer wall 744 at the downstream end 742 of the aerator 714. One or more stopper coupling features 772, for example, spikes may extend from the downstream end of the outer wall 744 in a downstream direction.

In use, the beverage may flow into the open upstream end of the aerator 714, contact the upstream wall 750*a* of the baffle 746 and change direction and flow through the apertures 752*a* therein, contact the intermediate upstream wall 750*c* and change direction and flow through apertures 752*c* therein, contact the intermediate downstream wall 750*d* and change direction and flow through the apertures 752*d* therein, and contact the downstream wall 750*b* and change direction and flow through the apertures 752*b* therein and flow out of the open downstream end of the aerator 714. Therefore, the beverage may flow in a direction away from the closed end of the bottle 310 from a location upstream of the aerator 714 along the interior surface 328 of the bottle 310, may be directed or constricted by the aerator 714 to flow in a circuitous path away from the bottle interior surface 328 and along the aerator 714 in a direction toward the open end 332, and may expand away from the aerator 714 to flow toward the interior surface 328 of the bottle neck 324.

Figure 8A:
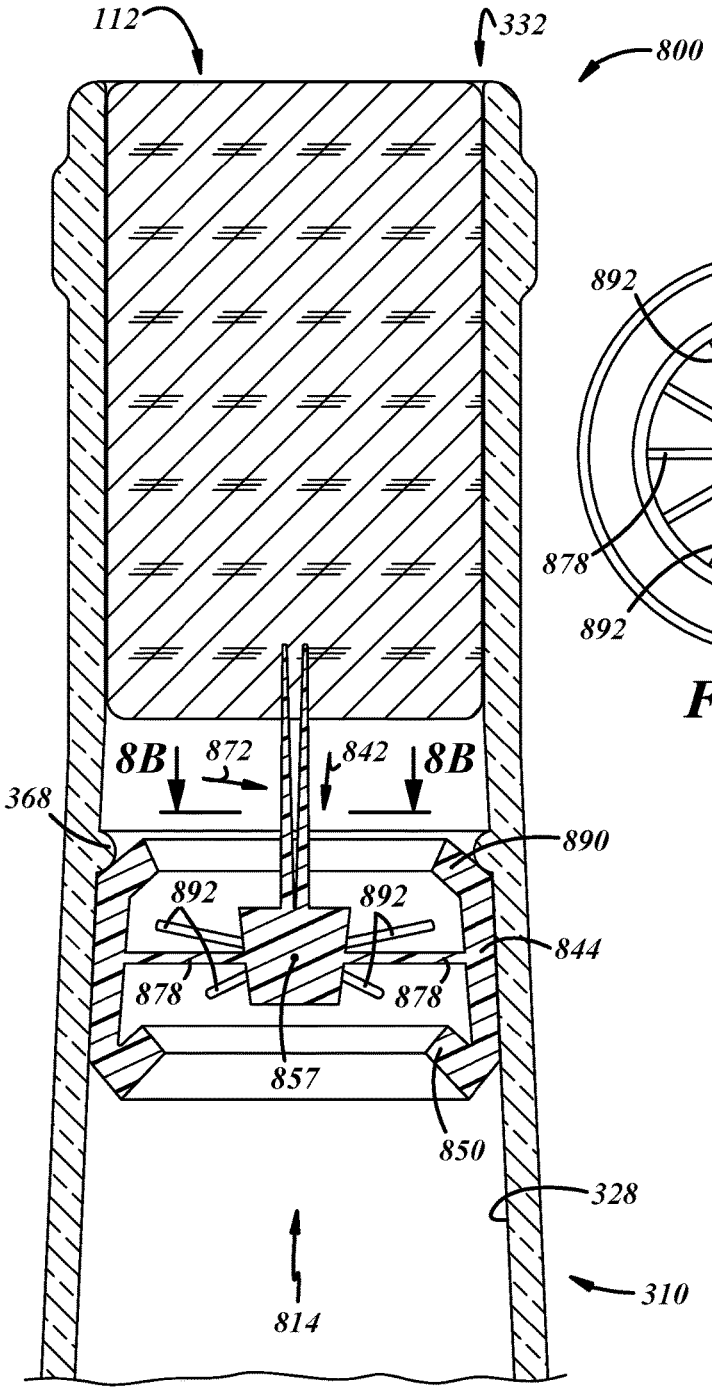
FIG. 8A is a fragmentary sectional view of a package including a bottle, and a stopper and an aerator disposed in the bottle, in accordance with an eighth illustrative embodiment of the present disclosure.
Figure 8B:
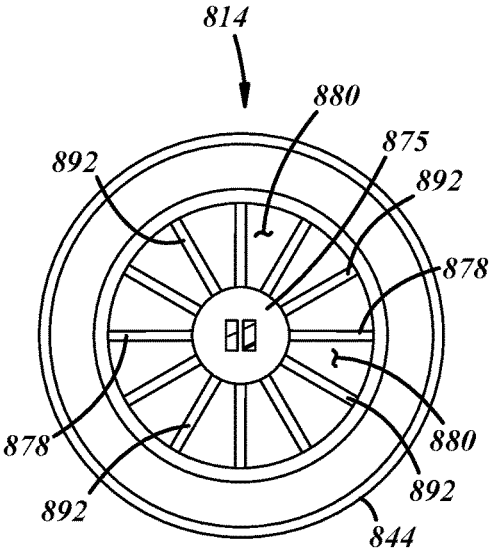
FIG. 8B is fragmentary sectional view of the package of FIG. 8A, taken substantially along line 8B of FIG. 8A, with the bottle removed for clarity.

Referring to FIG. 8A, a package 800 may include the bottle 310, and the stopper 112 and an aerator 814 carried in the bottle 310. The aerator 814 may be of unitary or single-piece construction. The aerator 814 includes an outer wall 844 in contact with the interior surface 328 of the bottle neck 310. The aerator 814 also includes a baffle 846 that may include a first funnel or frusto-conical wall 850 that extends from an upstream end of the outer wall 844 and in a radially inward and axially downstream direction. The baffle 846 also may include a second funnel or frusto-conical wall 890 that extends from a downstream end of the outer wall 844 and in a radially inward and axially downstream direction. The baffle 846 additionally includes spokes 878 extending radially inwardly from the outer wall 844, and a hub 857 connected to the outer wall 844 by the spokes 878. The circumferential spacing of the spokes 878 may be such that circumferential spaces 880 are established between the spokes 878 with no circumferential overlap of the spokes 878. The hub 857 may be frusto-conical with a smaller diameter at an upstream end and a larger diameter at a downstream end. The baffle 846 also may include projections 892 extending at a non-zero angle with respect to a plane established by the spokes and/or at a non-zero angle with respect to the longitudinal axis A of the package 800. One or more stopper coupling features 872, for example, spikes may extend from the downstream end of the hub 857 in a downstream direction.

In use, the beverage may flow into the open upstream end of the aerator 814, contact the first funnel 850, the hub 857, projections 892, and spokes 878, flow through the spaces 880 between the spokes 878 and flow over the second funnel 890 out of the open downstream end of the aerator 814. The first funnel 850 may direct the beverage flow radially inward, the hub 857 and/or projections 892 may direct the beverage flow radially outward, and the second funnel 890 may direct the beverage flow radially inward. Therefore, the beverage may flow in a direction away from the closed end of the bottle 810 from a location upstream of the aerator 814 along the interior surface 328 of the bottle 310, may be directed or constricted by the aerator 814 to flow in radially inward and outward directions away from and toward the bottle interior surface 328 and along the aerator 814 in a direction toward the open end 332, and may be expanded away from the aerator 814 to flow toward the interior surface 328 of the bottle neck 324.

According to another embodiment, a method of producing a beverage package includes forming a bottle and inserting a aerator into the bottle.

The bottle may be formed in any suitable manner. The bottle includes a base, a sidewall extending from the base, a shoulder extending from the sidewall, and a neck extending from the shoulder and including an open end having an end surface, an interior, and an interior surface.

In one example, the glass bottle can be fabricated in a press-and-blow manufacturing operation, wherein a molten glass charge or gob is placed in a blank mold and a plunger is moved into the blank mold to form the molten glass gob against the inside surfaces of the blank mold. The glass preform or parison is then removed from the blank mold and placed in a blow mold, in which the parison body and a major portion of the neck are stretched by blow gas (usually air) against the internal surfaces of the blow mold while the neck finish remains in the geometry formed in the blank mold.

In another example, the glass bottle can be formed in a blow-and-blow manufacturing operation, wherein a gob of glass is loaded into an inverted parison mold having neck rings at its bottom end, a baffle is applied to the open top end of the parison mold, and a settle blowing pressure is applied to the gob of glass to force the molten glass into the cavity defined by the neck rings. Subsequently, a counter blow pressure is applied through the bore of the neck rings to blow the gob of glass into intimate engagement with the walls of the parison mold and form a parison having a hollow interior. The baffle is then removed, the parison mold opened, and the inverted parison is transferred to an upright position by the neck rings where it is enclosed within the blow mold by closing two blow mold halves thereon.

The aerator may be inserted into the bottle so that the aerator is disposed entirely within the interior of the bottle neck and spaced axially from the end surface of the bottle neck. The aerator may be coupled to a stopper wherein the stopper and the aerator are inserted into the bottle together. The aerator may include an aerator and/or a funnel or pour spout.

There thus has been disclosed a package and a related method that fully satisfy all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A beverage package that includes:

a bottle including a base, a sidewall extending from the base, a shoulder extending from the sidewall, and a neck extending from the shoulder and including an interior, an interior surface, and a mouth having an end surface; and an aerator separate from the bottle, extending across the interior of the bottle neck, and disposed entirely within the interior of the neck and spaced axially from the end surface of the bottle neck, and including an inlet end, an outlet end axially spaced from the inlet end, an outer wall in contact with the interior surface of the bottle neck, and a baffle disposed radially inwardly of the outer wall and axially between the inlet and outlet ends.

2. The beverage package set forth in claim 1 wherein the bottle includes an aerator retention feature integral with the interior surface of the bottle neck.

3. The beverage package set forth in claim 1 wherein the bottle includes an annular projection extending radially inwardly from the interior surface of the bottle neck, and the aerator includes an annular shoulder axially spaced from the inlet end of the aerator for cooperation with the projection of the bottle to retain the aerator within the bottle neck.

4. The beverage package set forth in claim 1 wherein the bottle includes an annular depression in the interior surface of the bottle neck, and the aerator includes an annular projection extending radially outwardly from the outer wall for cooperation with the depression of the bottle to retain the aerator within the bottle neck.

5. The beverage package set forth in claim 1 wherein the aerator is retained within the bottle neck by frictional fit between the aerator outer wall and the bottle neck interior surface.

6. The beverage package set forth in claim 1 wherein the aerator is a unitary article of manufacture.

7. The beverage package set forth in claim 1 wherein a stopper is received within the bottle neck axially between the aerator and the open end of the bottle, and the aerator includes a retainer extending in a direction downstream from the outlet end and being coupled to the stopper, and further wherein the retainer includes at least one spike.

8. The beverage package set forth in claim 7 wherein the at least one spike includes a plurality of spikes radially spaced apart and extending from the aerator outer wall.

9. The beverage package set forth in claim 7 wherein the at least one spike includes a plurality of spikes extending from a central portion of the aerator.

10. The beverage package set forth in claim 1 wherein the aerator includes a hub connected to the outer wall by the baffle.

11. The beverage package set forth in claim 10 wherein the baffle includes a plurality of circumferentially spaced vanes.

12. The beverage package set forth in claim 11 wherein the hub is disposed at the downstream end and the vanes are sail-shaped with radially extending sides and incurvate shaped sides.

13. The beverage package set forth in claim 11 wherein the vanes are helical-shaped with excurvate sides.

14. The beverage package set forth in claim 11 wherein the hub is disposed between the upstream and downstream ends and the vanes are spoke-shaped.

15. The beverage package set forth in claim 1 wherein the aerator includes a conduit disposed radially inwardly of the outer wall, and a transverse wall extending transversely between the conduit and the outer wall and including at least one aperture.

16. The beverage package set forth in claim 15 wherein the transverse wall is a frusto-conical funnel with a smaller diameter axially spaced from the upstream end of the aerator.

17. The beverage package set forth in claim 15 wherein the aerator conduit includes apertures extending radially therethrough and the baffle extends transversely across the aerator conduit and bisects the aerator conduit apertures.

18. The beverage package set forth in claim 17 wherein the baffle is a separate component coupled to the aerator conduit at the downstream end of the aerator.

19. The beverage package set forth in claim 15 wherein the aerator includes a longitudinally extending opening through the outer wall to circumferentially interrupt the outer wall.

20. The beverage package set forth in claim 1 wherein the baffle includes a frusto-conical wall extending in a radially inward and axially upstream direction from the aerator outer wall and including a central aperture and a plurality of other aperture disposed radially outwardly of the central aperture.

21. The beverage package set forth in claim 1 wherein the baffle includes a plurality of transverse walls extending radially inwardly from the outer wall and wherein at least one of the walls includes a plurality of apertures misaligned with respect to another plurality of apertures of at least one of the other transverse walls.

22. The beverage package set forth in claim 21 wherein the aerator includes an upstream portion and a downstream portion coupled to the upstream portion, and the plurality of transverse walls includes an upstream wall integral with the upstream portion, a downstream wall integral with the downstream portion, an intermediate upstream wall separately coupled to the upstream portion in a location downstream of the upstream wall, and an intermediate downstream wall separately coupled to the downstream portion in a location upstream of the downstream wall.

23. The beverage package set forth in claim 1 wherein the baffle includes a hub connected to the outer wall by another portion of the baffle that includes spokes, and wherein another portion of the baffle includes projections extending at a non-zero angle with respect to a plane established by the spokes and at a non-zero angle with respect to the longitudinal axis of the package.

24. The beverage package set forth in claim 23 wherein the aerator includes a frusto-conical inner wall extending from the outer wall at the upstream end, another frusto-conical inner wall extending from the outer wall at the downstream end, and wherein the hub is frusto-conical with a smaller diameter at an upstream end and a larger diameter at a downstream end.

* * * * *